US005417643A

United States Patent [19]

Taylor

[11] Patent Number: 5,417,643

[45] Date of Patent: May 23, 1995

[54] CONTINUOUS PASSIVE MOTION EXERCISE DEVICE

[75] Inventor: Marc D. Taylor, Columbus, Ohio

[73] Assignee: Danninger Medical Technology, Inc., Columbus, Ohio

[21] Appl. No.: 143,931

[22] Filed: Oct. 27, 1993

[51] Int. Cl.[6] ..... A61H 1/00

[52] U.S. Cl. ..... 601/33; 601/24; 601/26

[58] Field of Search ..... 601/23, 24, 26, 33, 601/89, 92, 93; 482/70, 100, 124, 131, 139, 907

[56] References Cited

U.S. PATENT DOCUMENTS 4,669,451 6/1987 Blauth et al. ..... 601/33
5,163,451 11/1992 Grellas ..... 601/33

FOREIGN PATENT DOCUMENTS 2030873 5/1992 Canada ..... 601/33
302122 4/1971 U.S.S.R. ..... 601/33
1243725 7/1986 U.S.S.R. ..... 601/33

*Primary Examiner*—Richard J. Apley
*Assistant Examiner*—Jeanne M. Clark
*Attorney, Agent, or Firm*—Hudak & Shunk Co.

[57] ABSTRACT

A continuous, passive motion device includes a chair to which a motivator assembly is attached for exercising the arm and shoulder of a patient seated therein. The assembly has two interconnected drive units, one of which provides elevation of the arm and the other its rotation when the arm is positioned in a connected pivotal orthosis. The drive units communicate with each other through a microcontroller programmable to avoid exercise physiologically incompatible with the patient's proper range of movement, thereby avoiding exercise-induced trauma.

18 Claims, 3 Drawing Sheets

CONTINUOUS PASSIVE MOTION EXERCISE DEVICE

TECHNICAL FIELD

This invention relates to a physical therapy device useful in the treatment of infirmities of the arms and shoulders. More particularly, this device relates to a physical therapy device that can be used in the orthopedic treatment or functional reduction of the upper limbs and shoulders. Specifically, this invention relates to a physical therapy device that permits a user's arms to be treated by elevation, that is, by flexion and extension, in the scapular plane, and by external and internal rotation, i.e., movement of the arms transverse to the scapular plane.

BACKGROUND

Continuous passive motion therapy has long been known to provide significant benefit during the post-surgical or injury-treatment phase of such things as orthopedic replacements, adhesive capsulitis, manipulation under anesthesia, anterior stabilization, fixed proximal humeral fractures, synovectomies, rotor cuff repairs, subacromial decompressions, surgical reconstructions, shoulder arthroplasty, acromioplasty, soft tissue surgery in the axilla or in the shoulder girdle area, stabilized fractures, burns, and at other times such as in cases of arthritis or muscular dystrophy to mention but a few.

While physical therapists are often used to provide such therapy, their treatments are generally expensive and such skilled individuals are not always available when they are needed. As a consequence, there have been many attempts in the past to develop apparatus capable of providing continuous passive motion therapy.

Among these devices may be mentioned articulated structures designed to bear the limbs to be reeducated. Such structures, often associated with complicated systems of pulleys, cables and counter weights, can provide stability while admitting of relative displacement through pivoting motions. Although these systems provide passive mobilization, they have an unfortunate tendency to be cumbersome and difficult to adjust properly so as to fit a particular patient's need.

One passive motion device, shown in U.S. Pat. No. 5,179,939, teaches a shoulder exerciser which moves a patient's arm reciprocally back and forth through an arc of up to 180 degrees, thereby providing both flexion and abduction of the shoulder. The arm holder of the device is slidably and pivotally mounted so that the patient's arm can move toward and away from the patient's body, pivoting in order to allow the shoulder joint to follow a neutral anatomical range of motion.

Yet another such device is taught in U.S. Pat. No. 4,651,719 which discloses a portable apparatus that fits against the user's torso. Adduction and abduction of the arm are made possible by a lineal actuator extending between the base of the device and an upper arm support. Additional linkage is provided in order to permit rotation of a forearm support as the upper arm support is pivoted.

Notwithstanding the preceding and numerous other attempts to provide continuous passive motion to patients in need of the same, it has been difficult to design a device that imparts a desired passive treatment to the user's shoulder. In part, this has been the result of the fact that the shoulder is formed by the lateral juncture of the body's clavicle, scapula, and humerus. Such a structure produces a ball-and-socket-type of articulation between the proximal humerus and the glenoid cavity of the scapula. The socket of this structure is shallow, however, and the joint capsule is loose-fitting as a consequence. While the joint permits a wide range of motion, it has rather poor stability and inferior strength.

Furthermore, where two separate and distinct passive motions of the arm and shoulder are attempted simultaneously, for example, where lateral rotation of the arm is initiated at the same time that the arm's elevation is undertaken, it is unfortunately possible to simultaneously encounter angular positions of rotation and elevation that are physiologically incompatible with each other. When such positions are encountered, unless the situation is immediately recognized and movement of the device into the conflicting configuration avoided, severe trauma to the patient being exercised can easily occur, particularly in the shoulder area which is naturally weak as described.

One of the disadvantages of passive exercise machines of the type commonly employed prior to the device disclosed herein is that they often provide adjustment ranges of their several movements which allow combinations of motions that can be antagonistic relative to each other, either anatomically, or because of the nature of the condition responsible for the need to undergo therapeutic treatment. This fact coupled with the fact that passive motion exercise machines can be often used by untrained persons, and without proper supervision, presents a real risk that the devices will be used improperly and that injuries will result as a consequence thereof.

In view of the foregoing, therefore, it is a first aspect of this invention to provide an improved continuous passive motion exercise device.

A second aspect of this invention is to provide a continuous passive motion exercise device that provides elevation of the arm, as well as the rotation thereof.

An additional aspect of this invention is to provide a continuous passive motion exercise device in which the elevation drive means and the rotation drive means are coordinately controlled by an electronic microcontroller.

A further aspect of this device is to provide a continuous passive motion exercise machine in which the elevation drive means and the rotation drive means are subject to control by a programmable electronic microcontroller that prevents physiologically incompatible positioning of the limbs being manipulated.

Another aspect of this invention is to provide a continuous passive motion exercise device that avoids injuries caused by the device to individuals using the same.

Yet an additional aspect of this invention is to provide a continuous passive motion exercise device capable of exercising an individual's arm in one of two separate motions; in two different motions conducted simultaneously; or in two different motions performed sequentially.

Still a further aspect of this invention is to provide a continuous passive motion exercise device equipped with an orthosis designed to minimize the effects of misalignment between the pivot point of the device's elevation drive mechanism, and the pivot point of the patient's shoulder.

BRIEF DESCRIPTION OF THE INVENTION

The preceding and other aspects of the invention are provided by a continuous passive motion manipulation device for exercising a patient's arm and shoulder. The device comprises patient seating means and a motivator assembly attached to the seating means for manipulating the patient's arm and shoulder. The motivator assembly includes means for arm elevation, as well as means for arm rotation, and an orthosis connected to the motivator assembly for holding the arm during the manipulation. Programmable means are provided for coordinately controlling the arm elevation means and arm rotation means, the same being programmed to avoid physiologically incompatible combinations of arm elevations and arm rotations that might produce arm and shoulder trauma.

The preceding and additional aspects of the invention are provided by a continuous passive motion manipulator device for exercising a patient's arm and shoulder comprising a chair and a motivator assembly adjustably connected to the chair for manipulating the patient's arm and shoulder. The motivator assembly comprises a first drive unit for arm elevation in the arm's scapular plane, and a second drive unit for arm rotation in a plane transverse to the scapular plane, the second drive unit being fastened to the first drive unit by first pivot arm means. An orthosis is connected by second pivot arm means to the motivator assembly for holding the arm during the manipulation. The device also includes programmable means for coordinately controlling the arm elevation and the arm rotation, the programmable means being electronically programmed to avoid physiologically incompatible combinations of arm elevations and arm rotations capable of producing arm and shoulder trauma.

BRIEF DESCRIPTION OF DRAWINGS

The invention will be better understood when reference is had to the following drawings, in which like-numbers refer to like-components, and in which.

DETAILED DESCRIPTION OF THE INVENTION

Figure 1:
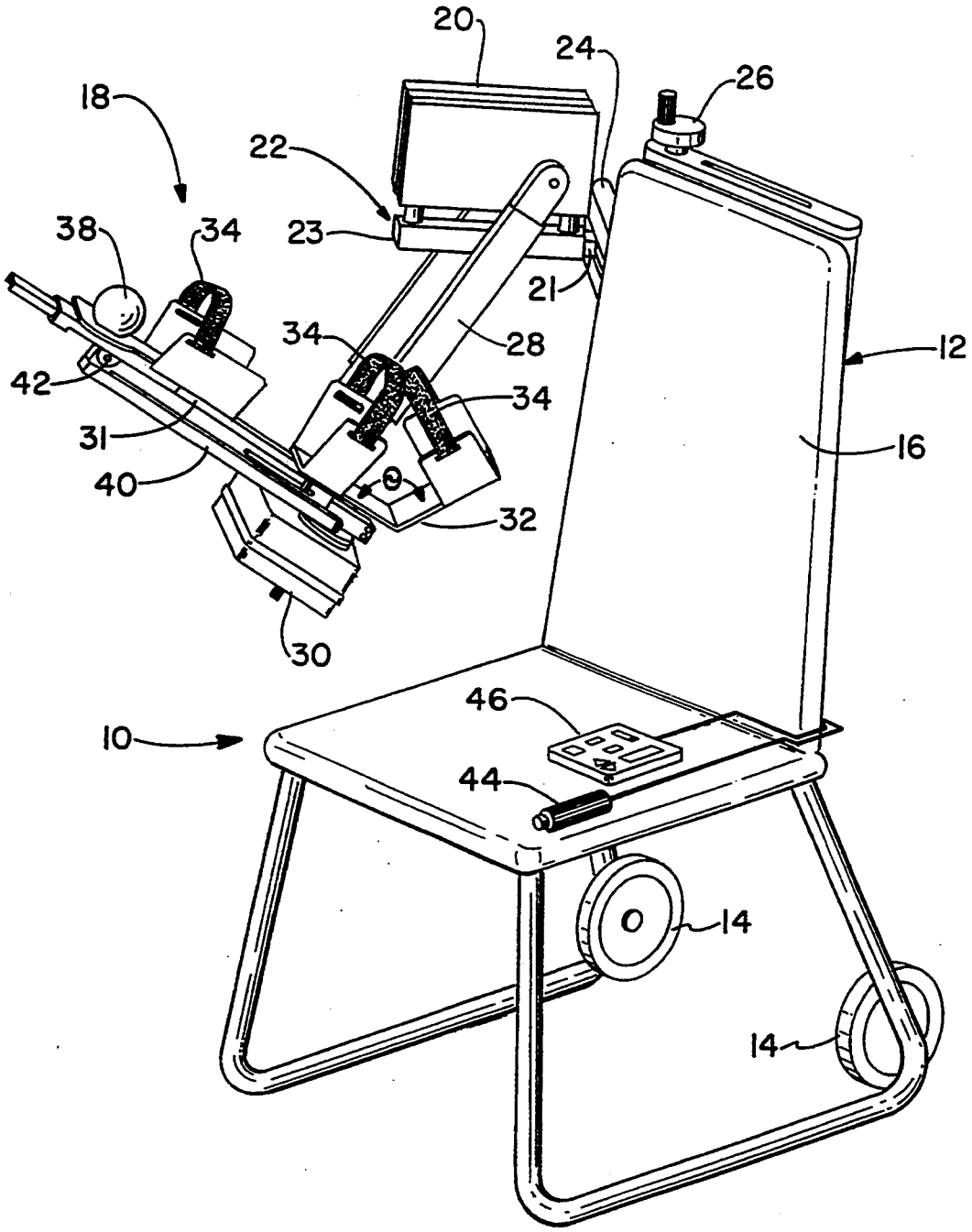
FIG. 1 is an isometric view of the device of the invention.

FIG. 1 is an isometric view of the continuous passive motion device of the invention, generally 10. As shown, a motivator assembly, generally 18, is attached to a patient treatment chair, generally 12. The chair 12 is movable as a result of wheels 14 attached thereto and a handle, not shown, and it includes a back member 16 to which the motivator assembly 18 is attached by means of adjustment bracket 24.

The motivator assembly 18 has an elevation drive unit 20 adjustably mounted to support bracket 22. Elevation pivot arms 28 are further connected to the elevation drive unit 20, and at their lower end are connected to a rotation drive unit 30 through a connecting bracket 29, better seen in FIG. 2. Connected to rotation drive unit 30 is a rotation pivot arm 40 to which is pivotally connected an orthosis cradle, generally 32. The orthosis cradle 32 comprises a base member 31, one end of which is bent at an angle Θ to accommodate the patient's forearm and a portion of the upper arm. The orthosis 32 has three arm-restraining clamps 34, and a hand grip member 38.

Also associated with the chair is a control pendant 46, and an emergency shut-off switch 44.

The motivator assembly 18 may be raised or lowered to accommodate the patient's anatomy by means of a crank member 26. In addition to being vertically adjustable through rotation of adjustment crank 26, other individual components of the motivator assembly are adjustable as well. Adjustment bracket 22 is extensible, for example, by means of a structure comprising a rod 21 slidably positioned in a hollow tube 23 and held in a desired position by one more set screws. The construction described allows the drive mechanism to be moved forward or backward along the patient's scapular plane, as required.

Figure 2:
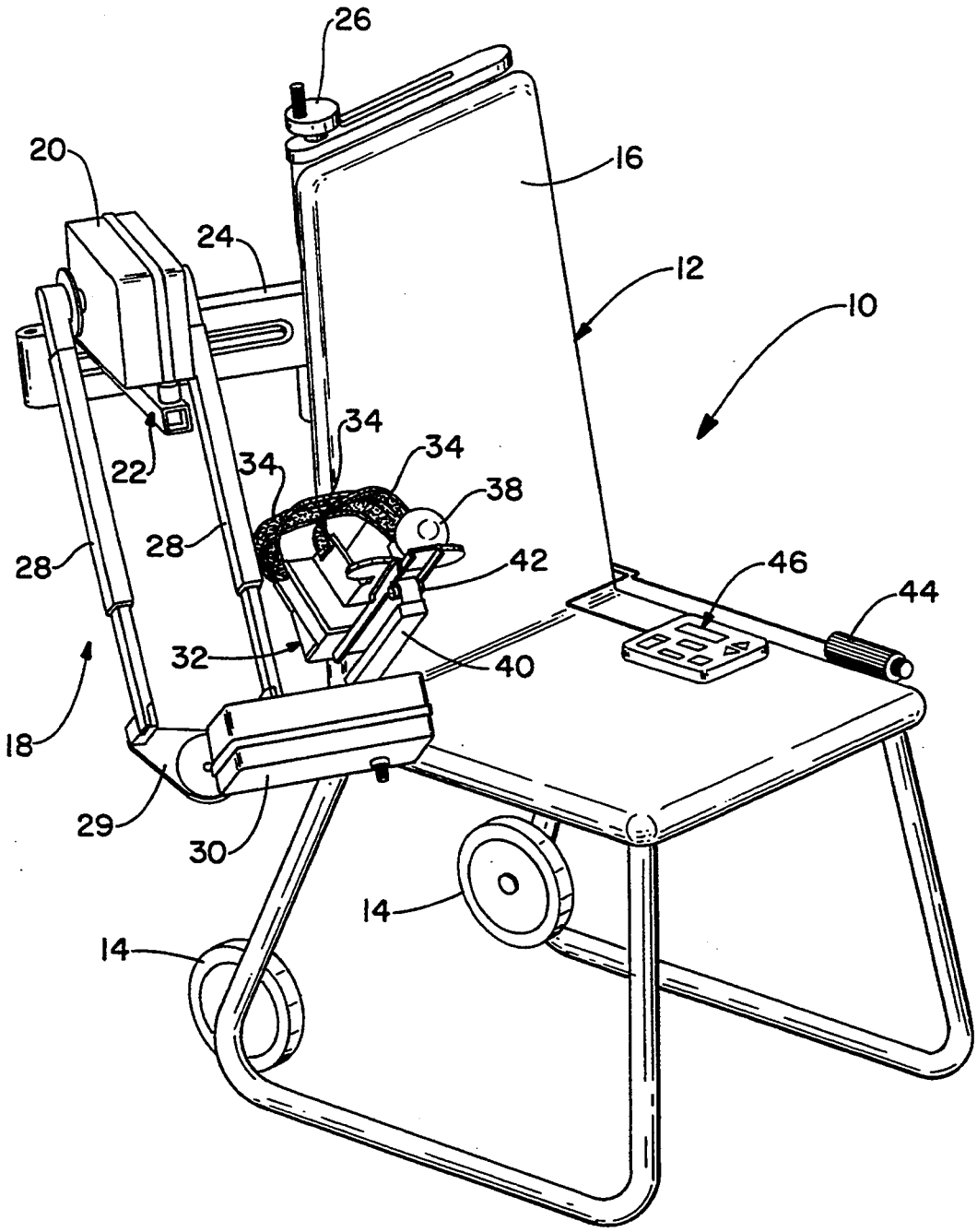
FIG. 2 is an isometric view of the device of the invention from a different perspective.

In addition, elevation pivot arm 28 can be lengthened or shortened by a similar or equivalent structure, better seen in FIG. 2, and secured in that position by set screws or some equivalent anchoring restraint. Rotation pivot arm 40 is likewise adjustable backward or forward through structures similar to those described or other structure of the type well known in the art, and the orthosis 32, which is pivotal around pivot point 42 is also movable backwards or forward by sliding structure equivalent to that already described.

While the amount of adjustment can be determined within a broad range, frequently the elevation pivot arm will be provided with a range of adjustment of from about $9\frac{1}{4}$ to 14 inches; the rotation pivot arm will be adjustable through a range of about 8 to $12\frac{3}{4}$ inches, and the position of the orthosis hand grip 38 will have a positional range of adjustment of from about $6\frac{3}{4}$ to approximately 8 inches.

As illustrated in FIG. 1, the support bracket 24 is attached by means of pin connections, not shown, to the chair back 16 at an angle such that the adjustment bracket 22, connected at approximately right angles to the support bracket, lies along the scapular plane of a patient seated in the chair 12. The elevation drive unit 20 enables the device to move a patient's arm through a range of motion extending from about 30 degrees, at which point the patient's upper arm lies at an angle of about 30 degrees relative to the longitudinal axis of the patient's upper torso, i.e., a position in which the upper arm lies substantially at the patient's side, to an angle of about 180 degrees, at which point the arm has been elevated to approximately an overhead position.

With respect to the rotation drive 30, the unit is capable of rotating the patient's forearm located in the orthosis cradle 32 through an arc of about 90 degrees. Such rotation is transverse to the patient's scapular plane and can extend inwardly, internally, about 45 degrees, or outwardly, externally, for about 45 degrees from a neutral plane in which the orthosis is positioned. The neutral plane can be selected at any desired angle measured from a front-to-back longitudinal plane passing through the patient's upper torso.

The scapular plane in which adjustment bracket 22 is located will lie at about 35 degrees to the front-to-back longitudinal plane referred to.

The orthosis base member 31 is operatively joined to the elevation drive unit 20 by the linkage of the elevation pivot arm 28 and the rotation pivot arm 40. The relative angle of the linkage between the elevation pivot arm 28 and the rotation pivot arm 40 is fixed in the scapular plane, i.e. along the longitudinal axis of the pivot arm 28. The orientation of the rotation pivot arm 40 relative to the pivot arm 28 in regard to the internal and external rotation of the shoulder can be varied by selecting an appropriate setting on the rotation drive unit.

The orthosis base member 31 is pivotally connected at the forward end of the rotation pivot arm 40. Conversely, the elbow end of the orthosis base member 31 is free within the plane of the rotation pivot arm 40. Consequently, the orthosis pivots to accommodate the angle of the elbow and shift the effective axis of rotation of the shoulder to accommodate the anatomical axis of rotation of the patient. Other scissor linkages or suspension linkages could be used in which the relative angle between the orthosis and the drive means compensates for the shift in the effective axis of rotation of the shoulder. The scissor linkage compensates for the change in angle of the forearm relative to the rotation drive linkage at the hand end when the patient's elbow is free to flex or, alternatively, at the elbow end when the elbow angle is fixed. Thus, the radius and humerus form a four-bar linkage with the orthosis and the pivot arm. The orthosis base member 31 is free to pivot during the exercise, accommodating patient elbow flexion of from about 65 degrees to 90 degrees. This freedom is provided in order to prevent jamming or stretching forces acting on the patient's shoulder. Orthosis cradle angle $\Theta$ will typically range from about 90 degrees to 160 degrees, further facilitating proper alignment of the patient's arm during exercise. The structure described allows proper alignment to be easily initially obtained and maintained throughout the duration of the therapy session. Small patient movements are accommodated by the provisions described without significantly altering the intended movement of the device, and the prescribed exercise is readily repeatable throughout subsequent exercise periods.

The orthosis is also desirably padded for patient comfort, helping to assure patient compliance with the exercise regime.

FIG. 2 is an isometric view of the device of the invention from a different perspective. The figure illustrates a chair 12 having a back 16 to which is attached a support bracket 24. The bracket 24 is connected to an elevation power screw, not shown, or some similar device, which is operated by an adjustment crank 26. The support bracket 24 is connected to the adjustment means by a suitable connection, for example by a pin, at an angle to the chair back 16 such that an elevation drive unit 20, connected at right angles to the support bracket 24, lies in the scapular plane of a patient seated in the chair. The elevation drive unit is adjustable backward or forward along the scapular plane by adjustment bracket 22 as previously explained in connection with FIG. 1. Adjustable elevation pivot arms 28 connect the drive unit 20 to a rotation drive unit 30 through bracket 29. An orthosis cradle 32 is pivotally connected at pivot point 42 to rotation pivot arm 40, which in turn is connected to rotation drive unit 30. Orthosis cradle 32 includes orthosis restraining straps 34, and a hand grip 38. The restraining straps 34 are conveniently fastened by means of velcro straps, and the hand grip 38, which is formed from some compressible material such as polyurethane foam or the like, is adjustable in a forward or rearward direction, as previously indicated.

The chair 12 is also provided with wheels 14, and desirably a handle, not shown, so that the chair may be easily moved from location-to-location.

Also associated with the device 10 is a control pendant 46 by means of which the parameters of the exercise are set, and an emergency switch 44 is provided for stopping the exercise in the case of misadventure.

As will be noted, the passive motion manipulative device illustrated requires two drive mechanisms, an elevation drive unit 20, and a rotation drive unit 30. The drives use brushless DC motors and employ worm gears for the driving function and for speed reduction.

Oftentimes it will be desirable to have a series of cycle times available for selection by the exerciser, and these will conveniently be provided through the use of variable speeds. For example, it is often desirable to provide cycle times, including acceleration and deceleration ramping, as follows. With respect to elevation, a high speed cycle time might involve movement of the elevation drive unit equivalent to a movement of the elevation pivot arm 28 of about 2 degrees per second. This would provide a cycle time of about 2.5 minutes for travel from 30 degrees to 180 degrees and return to the 30 degree position. A low speed might involve movement of the rotation drive at a rate of about 1 degree per second, providing a 5 minute cycle.

A reasonable high speed rotation would be about 2 degrees per second, entailing a cycle time of about 1.5 minutes to proceed from an internal rotation position of $-45$ degrees, to an external rotation position of $+45$ degrees, followed by return to the initial starting position. Similarly, a low speed cycle might require a rotational speed of about 1 degree per second, providing a cycle time of approximately 3 minutes to proceed through the cycle described.

While FIGS. 1 and 2 illustrate the passive motion manipulation device of the invention in which the motivator assembly is positioned to receive the right arm of the patient being exercised, the device permits removal of the assembly and attachment to the left side of the chair for exercise of a patient's left arm and shoulder. This is made possible through the provision of vertical adjustment means similar to those already described provided on the left side of the chair, but which are not illustrated. Such a right-to-left transfer could be accomplished, for instance, simply by removing support bracket 24 and reattaching it on the left side of the chair by means of a pin or other component to a power screw, also adjustable by a vertical adjustment crank such as that of 26.

Figure 3:
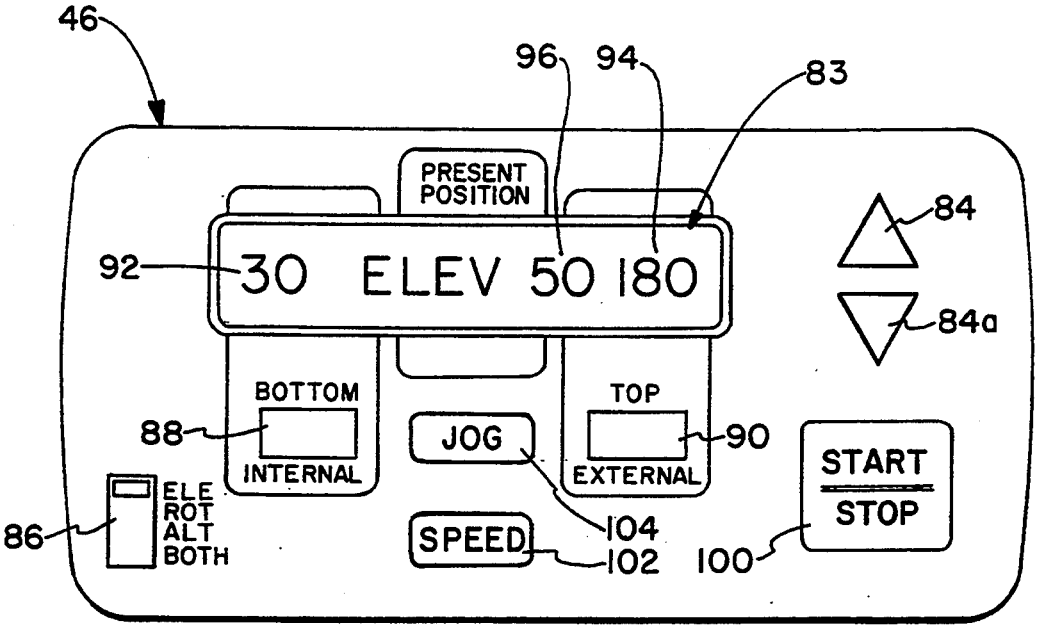
FIG. 3 is a top-plan view of a pendant controller of the invention.

FIG. 3 is a top plane view of a pendant controller of the invention. As shown, the control pendant 46 includes a display screen 83 on which the exercise limits set for the device are seen, and where present position information regarding the device is provided. Further included is a minimum limit selector 88 and a maximum limit selector 90. An exercise mode switch 86 forms part of the controller, as does adjustment direction indicators 84 and 84a, and a start/stop switch 100. A cycle speed switch 102 is also furnished, as is a position locator adjustment 104.

In setting up an exercise, the following procedure is followed. Firstly the exercise mode selector 86 is moved into one of the following positions respectively, elevation; rotation; alternating, or both, in the later case rotation and elevation proceed simultaneously. Next the exercise limits are set by activating limit selectors 88 and 90, at which time the limits set will appear in the display screen 83. The limit selectors will be moved upward or downward depending upon which adjustment direction indicator is activated, i.e., 84 or 84*a*. The speed of the exercise is determined by activation of the cycle speed switch 102, the speed selected being shown on the display screen 83. Finally, the start/stop switch 100 is activated to begin or terminate the exercise. Activation of the position locator adjustment "jog" allows the exercise device to be moved as long as the switch is activated, maintaining it in the set position when the activation switch is released.

Figure 4:
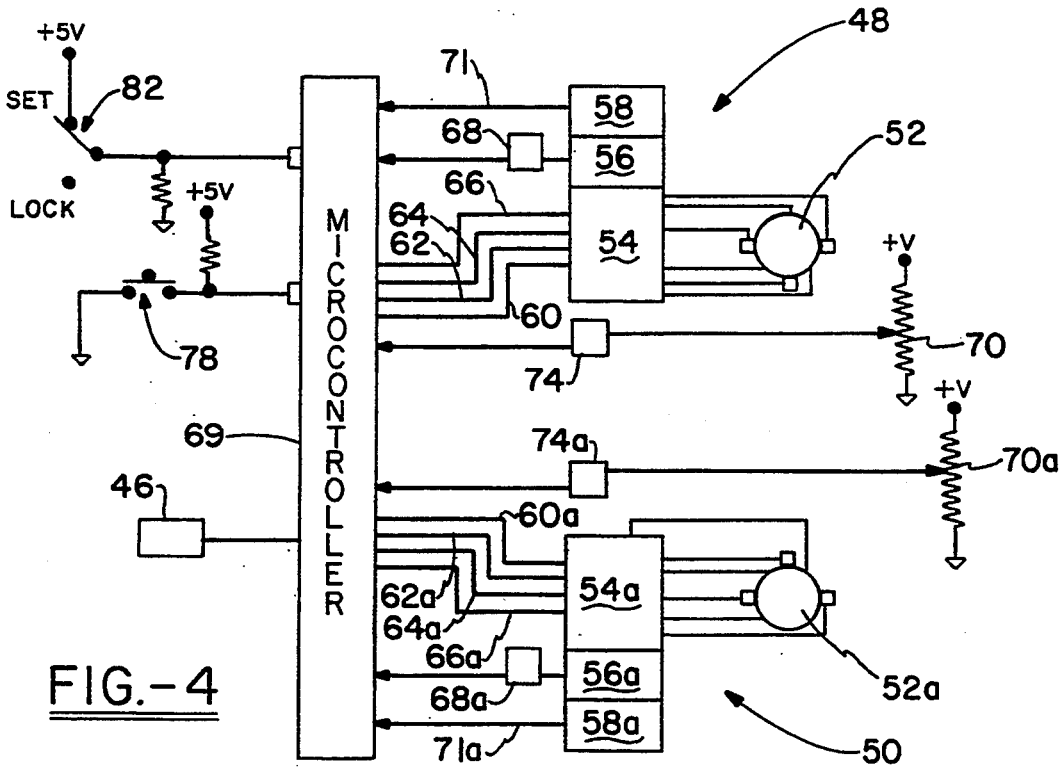
FIG. 4 is a schematic circuit diagram of the device of the invention.

FIG. 4 is a schematic circuit diagram of the device of the invention. Referring to the figure the circuit includes an elevation drive 52, and a rotation drive 52*a*. Each of the drives, respectively, includes a motor driver 54, 54*a*; a motor current detector 56, 56*a*; and a motor speed detector 58, 58*a*. The motor drives 54, 54*a*, are connected to a coordinating microcontroller 69 by output enabler connectors 60, 60*a*; motor brake connectors 62, 62*a*; direction controller connectors 64, 64*a*; and speed connectors 66, 66*a*. The motor current detectors 68, 68*a*, are connected to microcontroller 69 through digital-to-analog converters 68 and 68*a*. Motor speed detectors 58 and 58*a* are connected to microcontroller 69 through connectors 71 and 71*a*.

Elevation potentiometer 70 is connected to microcontroller 69 through digital-to-analog convertor 74, while rotation potentiometer 70*a* is connected to microcontroller 69 through digital-to-analog converter 74*a*. Also attached to microcontroller 69 are control pendant 46, emergency shut off switch 78, and a lockout switch 82, the latter preventing the patient from exercising control over the device when such intervention is undesirable.

As is apparent from the figure, the elevation drive portion of the circuitry 48 is able to communicate with the rotation drive portion of the circuitry 50 through the microcontroller 69. This is an important feature of the invention since it prevents positional physiologically incompatibility of the elevational movements of the device, with the rotational movements thereof. While the microcontroller may be located at any protected location in the device, it is commonly located in the elevational drive box.

Although the combinations of positional adjustment provided for within the control range, i.e., rotational 45 internal, 45 external, and elevational 30 degrees flexion, 180 degrees extension, are physiologically compatible in healthy individuals, the communication provided for as described allows the setting of the microcontroller 69 so that combinations involving the risk of trauma to individuals suffering from particular infirmities can be avoided.

The exercise device illustrated by the circuit diagram shown in the figure is powered by a transformer/rectifier providing 15 or 24 volt DC current from a standard 120 volt 50/60 cycle AC current wall socket. The use of DC drive motors provides the advantage that the DC current used by them is proportional to the torque being experienced. This not only provides informational feedback through the use of precision potentiometers capable of sensing the position of the drives, but allows set-point potentiometers to accurately determine the control positions desired. An additional advantage of the drives described derives from the fact that an unexpected dangerously high force level can be detected, and following such detection, the drive can be stopped and reversed for a small distance before being stopped completely. This safety measure is desirably located at a point where it is inaccessible to the exerciser, thereby avoiding risk of tampering.

The device described in the preceding is designed for portability either in a hospital or in a home. Consequently, the objective of easy portability dictates that construction of the device employ medical grade, lightweight plastic or metal such as PVC, polyethylene, nylon, etc., stainless steel, aluminum, as well as various natural and polyester fabrics. Ideally the device should weigh in the neighborhood of no more than about 40 to 50 lbs.

The duration of the exercises for which the machine is designed will depend upon the nature of the therapy being administered and like considerations; however, an exercise period of about 6 to 8 hours is typical.

While in accordance with the patent statutes, the best mode and preferred embodiment has been set forth, the scope of the invention is not limited thereto, but rather by the scope of the attached claims.

What is claimed is:

1. A continuous passive motion manipulation device for exercising a patient's arm and shoulder comprising:

patient seating means;

a motivator assembly attached to said seating means for synchronous manipulation of elevating and rotating the patient's arm and shoulder wherein said motivator assembly comprises:

a first drive means for arm elevation connected between a first arm means for operatively connecting the patient's upper arm and the seating means, and a second drive means for arm rotation connected between the first arm means and a second arm means for attaching the patient's forearm such that the axis of rotation of the second drive means is aligned with the humerus of the patient;

a pivotable orthosis connected to said motivator assembly for holding the arm during said manipulation, and programmable means for controlling said arm elevation means and the arm rotation means, programmed to avoid physiologically incompatible combinations of arm elevations and arm rotations capable of producing arm or shoulder trauma.

2. A device as set forth in claim 1, wherein said orthosis pivots about an axis which is perpendicular to the plane defined by an upper arm and a forearm.

3. A device as set forth in claim 1, wherein said orthosis has a hand end that is pivotally connected at said end.

4. A device according to claim 1, wherein said programmable means includes adjustable controls that are configured to determine said parameters of manipulation of the device.

5. A device according to claim 1, in which said seating means is a chair.

6. A device according to claim 1, in which said first drive means comprises:

a first drive unit for arm elevation in the arm's scapular plane, and said second drive means comprises:

a second drive unit for arm rotation in a plane transverse to the scapular plane, said motivator assembly being connected to said seating means through said first drive unit, and said second drive unit being fastened to said first drive unit by first pivot arm means, and to said orthosis by second pivot arm means.

7. A device according to claim 6, in which said first drive unit is connected to said seating means by a positionally adjustable bracket, and said first and second pivot arm means are also positionally adjustable.

8. A device according to claim 6, in which said orthosis is a pivotable, angular cradle in which the forearm is confined.

9. A continuous passive motion manipulator device for exercising a patient's arm and shoulder comprising:

a chair;

a motivator assembly adjustably attached to said chair for synchronous manipulation of elevating and rotating the patient's arm and shoulder, said motivator assembly comprising:

a first drive means for arm elevation connected between a first arm means for operatively connecting the patient's upper arm and the chair, and a second drive means for arm rotation connected between the first arm means and a second arm means for attaching the patient's forearm such that the axis of rotation of the second drive means is aligned with the humerus of the patient;

programmable means for controlling the arm elevation and the arm rotation programmed to avoid physiologically incompatible combinations of arm elevation and arm rotation capable of producing arm and shoulder trauma, and a pivotable orthosis connected by second pivot arm means to said motivator assembly for holding the arm during manipulation.

10. A device according to claim 9, in which said chair includes wheels attached thereto to facilitate its relocation.

11. A device according to claim 9, wherein said programmable means include adjustable controls that are configured to determine the parameters of manipulation of the device.

12. A device according to claim 11, in which said controls include goniometer controls; an exercise rate control; an exercise sequence control; and an on-off control.

13. A device according to claim 10, in which said orthosis is a pivotal angular cradle in which the forearm is confined.

14. A device according to claim 9, in Which the motivator assembly can be attached to either side of said chair to permit the exercise of either of the patient's arms and shoulders.

15. A continuous passive motion apparatus for exercising a patient's arm and shoulder by synchronously elevating the arm about the shoulder joint and rotating the arm about the longitudinal axis of the humerous comprising:

a first drive means for arm elevation connected between a first end of an elevation pivot arm for operatively connecting the patient's upper arm and a seating means, a second drive means for arm rotation connected between a second end of the elevation pivot arm and a first end of a rotation pivot arm for attaching the patient's forearm such that the axis of rotation of the second drive means is aligned with the humerus of the patient, the arm cradle means being supported by at least one of said elevation and rotation pivot arms, and programmable means to coordinately control the first drive means and the second drive means.

16. A continuous passive motion apparatus as set forth in claim 15, wherein said arm cradle is supported by said rotation pivot arm.

17. A continuous passive motion apparatus as set forth in claim 16, wherein said arm cradle has a first end and a second end and said second end is distal relative to the arm of the patient and said arm cradle is pivotally joined at its second end to the second end of the rotation pivot arm.

18. A continuous passive motion apparatus as set forth in claim 15, wherein the apparatus can impart synchronous elevation and rotation of the patient's arm by controlling the elevation drive means and the rotation drive means to work together in a programmed motion.

* * * * *